United States Patent [19]

Shroff

[11] 4,427,916

[45] Jan. 24, 1984

[54] HEATING ELEMENT FOR INDIRECTLY HEATED CATHODE AND METHOD FOR THE MANUFACTURE OF SUCH AN ELEMENT

[75] Inventor: Arvind Shroff, Paris, France

[73] Assignee: Thomson - CSF, Paris, France

[21] Appl. No.: 232,571

[22] Filed: Feb. 9, 1980

[30] Foreign Application Priority Data

Feb. 15, 1980 [FR] France ..... 80 03410

[51] Int. Cl.[3] ..... H01J 1/14; H01J 17/06; H01K 1/04

[52] U.S. Cl. ..... 313/346 R; 174/52 PE; 174/110 A; 313/341; 313/345; 501/152

[58] Field of Search ..... 219/541, 544, 552, 553, 219/270, 275; 313/337, 340, 341, 344, 345, 346 R; 361/264, 265, 266; 29/611; 174/110 A, 52 PE; 501/152

[56] References Cited

U.S. PATENT DOCUMENTS

| | | | |
|---|---|---|---|
| 2,975,078 | 3/1961 | Rayfield | 174/110 A |
| 3,400,294 | 9/1968 | Kling | 313/340 |
| 3,803,441 | 4/1974 | Ohsawa et al. | 313/340 |
| 3,947,373 | 3/1976 | Sobajima et al. | 174/110 A |
| 4,150,318 | 4/1979 | Kerstetter | 313/346 R |
| 4,181,532 | 1/1980 | Woodhead | 501/152 |
| 4,331,627 | 5/1982 | Yamamoto et al. | 501/152 |
| 4,345,111 | 8/1982 | Petitcolas | 174/110 A |

FOREIGN PATENT DOCUMENTS

| | | | |
|---|---|---|---|
| 1107308 | 5/1961 | Fed. Rep. of Germany | 174/110 A |
| 1805821 | 6/1970 | Fed. Rep. of Germany | 313/340 |
| 1315581 | 12/1962 | France | 313/340 |
| 1133333 | 11/1968 | United Kingdom | 174/110 A |

OTHER PUBLICATIONS

"Materials and Techniques for Electron Tubes" by Kohl, General Telephone and Electronics Technical Series, pp. 85–89, Mar. 2, 1972.

*Primary Examiner*—Saxfield Chatmon
*Attorney, Agent, or Firm*—Roland Plottel

[57] ABSTRACT

This heating element is constituted by a filament and a mixture, fritted at between 1700° and 1800° C., of alumina and less than 10% by weight of yttrium oxide. This mixture fills the space left free by the filament within the cylinder closed by an emissive disk forming the cathode.

10 Claims, 5 Drawing Figures

HEATING ELEMENT FOR INDIRECTLY HEATED CATHODE AND METHOD FOR THE MANUFACTURE OF SUCH AN ELEMENT

The present invention relates to a heating element for an indirectly heated cathode. It also relates to the method for the manufacture of such an element.

Indirectly heated cathodes which are used in electron tubes are well known from the prior art. They generally comprise an emissive disk brazed to one of the ends of a cylinder made from a non-emissive material which serves as a box or casing. A filament for indirectly heating the cathode is placed within the cylinder.

A distinction is made between two types of indirectly heated cathodes. In the first type, heating is by a "free" filament which heats the cathode by radiation. The second type involves heating by a "potted" filament. The space within the cylinder, not occupied by the filament is filled with a material which is (i) a good heat conductor, (ii) electrically insulating at the operating temperature, (iii) whose melting point is high and (iv) which does not react with the filament and the cylinder at the operating temperature.

Cathodes indirectly heated by a "potted" filament, are less vulnerable to shocks and mechanical vibrations than in the case of cathodes heated indirectly by a free filament.

The present invention relates to cathodes indirectly heated by a "potted" filament.

In the prior art, the "potting" or member which locks the filament in the cylinder is formed by alumina powder fritted at about 2000° C. or by a mixture of alumina powder and calcium oxide powder fritted at between 1750° and 1800° C.

BRIEF SUMMARY OF THE INVENTION

According to the present invention, the "potting" is formed by a mixture of alumina and at least 10% by weight of an oxide of one of the elements of column IIIB of the periodic table of elements, said mixture being fritted at between 1700° and 1800° C.

According to a preferred embodiment of the invention, the mixture is formed by yttrium oxide and alumina of chemical composition $3Y_2O_3.5Al_2O_3$, plus $\alpha$-phase alumina.

The "potting" according to the invention has the following advantages. Fritting is carried out at between 1700° and 1800° C. and this temperature does not embrittle the tungsten or rhenium tungsten filament as is the case when heating to 2000° C. for fritting pure alumina powder. The "potting" is firm and compact, ensuring a good long-term, thermal contact between the filament and the cylinder. It also leads to an electrical insulation equal to that obtained with "potting" based on alumina alone. The yttrium oxide which can be used is stable and very pure. Its coefficient of $\alpha$ linear expansion, equal to $8.18.10^{-6}$ is very close to that of the generally used filaments and identical to that of alumina. It is therefore possible to obtain a potting, whose expansion coefficient does not depend on the alumina and oxide proportions. Moreover, the thermal conductivity yttrium oxide is identical to that of alumina ($\lambda=0.0017$cal. $S^{-1}.cm^{-1}.\theta^{-1}$ at 1800° C. and 0.013 at 1000° C.). Finally, the melting point of yttrium oxide (2410° C.) is below that of e.g. calcium oxide (2572° C.).

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
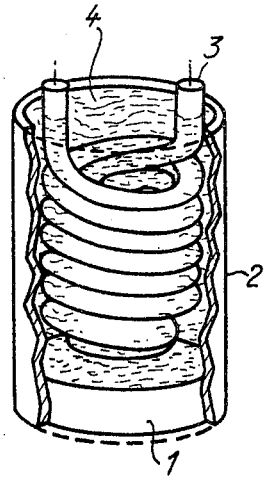
FIG. 1 a perspective view of an indirectly heated cathode with a "potted" filament.

The same reference numerals are used for the same parts in the various drawings, but for reasons of clarity the dimensions and proportions of the various parts have not been respected.

FIG. 1 is a perspective view of an indirectly heated cathode with a potted filament. This cathode is formed by an emissive disk 1 occupying one of the ends of a cylinder 2 made from non-emissive material.

Cylinder 2 is generally made from molybdenum and serves as a casing for the cathode and is also known as a cathode "skirt".

A porous tungsten disk 1 is brazed to one of the ends of cylinder, this process being performed at about 1900° C.

When brazing has taken place, a tungsten or rhenium tungsten filament 3 covered by cataphoresis with an alumina insulating layer is introduced into the cylinder. The "potting" 4 is formed and this locks the filament 3 in the cylinder.

At a temperature of about 1750° C., the porous tungsten disk 1 is impregnated with calcium and barium aluminate, which makes said disk emissive.

As the porous tungsten is impregnated at about 1750° C. whilst filament 3 is located in cylinder 2, no disadvantage results from the "potting" being formed at a temperature of 1700° or 1800° C., as is the case according to the invention.

According to the invention, the "potting" is formed by a mixture of alumina and at least 10% by weight of an oxide of one of the elements of column IIIB of the periodic table of elements, said mixture being fritted at between 1700° and 1800° C.

Column IIIB of the periodic table of elements contains four elements, namely scandium Sc, yttrium Y, lanthanum La and actinium Ac. Yttrium will be used as an example here.

Figure 2:
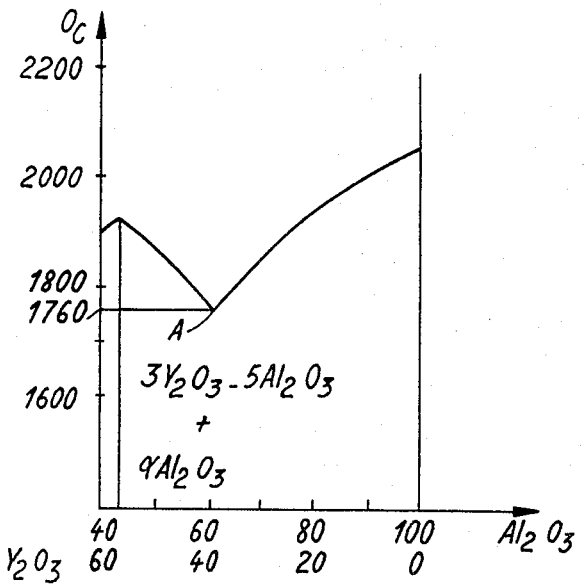
FIG. 2 a detail of the phase diagram of the alumina-yttrium oxide mixture.

FIG. 2 represents a detail of the phase diagram of the alumina-yttrium oxide mixture extracted from the work entitled "Phase diagrams for Ceramists— 1969—supplement".

The thick line curve indicates the melting temperature of the mixture of alumina $Al_2O_3$ and yttrium oxide $Y_2O_3$ as a function of the percentages by weight of the alumina and the yttrium oxide. The curve is discontinuous. For certain alumina and yttrium oxide percentages, melting takes place at a lower temperature than for other percentages, these being eutectic compositions.

In FIG. 2, it can be seen that for point A which essentially corresponds to 60% alumina and to 40% yttrium oxide, the melting point is 1760° C. Around point A, the melting point exceeds 1760° C. In the same way, it is remarkable that on the basis of more than 43% alumina, the mixture obtained in the solid state has the same chemical constitution, namely $3Y_2O_3.5Al_2O_3$, plus α-phase alumina.

It is of interest that the alumina-yttrium oxide mixture is an eutectic because, compared with pure alumina, the fritting temperature can be reduced. It is also of interest that the chemical composition of the solid product obtained is the same within a wide range of respective alumina and yttrium oxide percentages. Thus, it is difficult when forming a mixture of powders (in the present case alumina powder and yttrium oxide powder) to ensure that the mixture is completely satisfactorily formed and that the percentage of the substances present is constant. It is therefore of importance to obtain the same chemical compound, even if the mixture is not completely homogeneous.

Thus, it is desirable to utilize the advantages of the alumino-yttrium oxide mixture compared with pure alumina, whilst attempting to obtain a mixture containing the maximum quantity of alumina. If the mixture contains too much yttrium oxide, there is a risk of the potting being disengaged from the cylinder acting as a casing, as well as the detachment of the filament from its "potting".

It has experimentally been found that the potting leading to the maximum number of advantages is obtained by fritting at between 1700° and 1800° C. whilst limiting the yttrium oxide percentage to about 10% by weight.

However, a good potting is obtained by fritting a mixture containing approximately 50 to 99% alumina and consequently approximately 1 to 50% yttrium oxide at between 1700° and 1800° C. In all cases, an yttrium oxide-alumina mixture is obtained of chemical composition $3Y_2O_3.5Al_2O_3$, plus α-phase alumina.

FIG. 2 only shows the interesting part of the alumina-yttrium oxide phase diagram. In the rest of the diagram, the alumina percentage is low (below 40%) and the melting point and consequently fritting temperature are too high.

The alumina used in the potting composition can be constituted by several alumina varieties of different grain size distribution. Thus, for example, it is possible to use grains with a diameter of less than 10 μm, as well as those with a diameter of 10 to 50 μm.

The mixture of several varieties of alumina makes it possible to make a compromise between the defects and the advantageous qualities inherent in each variety. Thus, fine-grained alumina easily solidifies, but suffers from significant contraction, whilst large-grained alumina solidifies more difficultly, but forms a porous mass without contraction.

In the same way as described in detail for yttrium, the "potting" can be formed by fritting at between 1700° and 1800° C. a mixture of alumina and less than 10% of scandium, lanthanum or actinium oxide. The chemical composition of the bodies obtained will, in the case of lanthanum oxide, be $La_2O_3.11Al_2O_3$, plus α-phase alumina and, in the case of scandium oxide $Sc_2O_3.Al_2O_3$, plus α-phase alumina.

It is pointed out that the insulating layer deposited by cataphoresis on filament 3 can be an alumina layer, as stated in connection with FIG. 1. However, this insulating layer can also have the same composition as the mixture used for the potting, e.g. alumina and yttrium oxide.

Figure 3A:
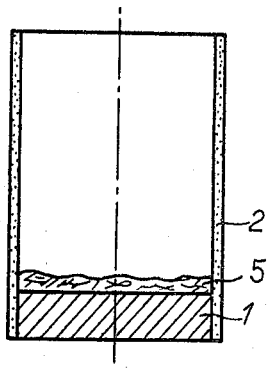
FIGS. 3*a, b* and *c* diagrams illustrating the manufacturing method according to the invention.

FIGS. 3*a, b* and *c* illustrate a method for the manufacture of a heating element according to the invention.

According to this method, the powder of an oxide of one of the elements of column IIIB of the periodic table of elements and one or more powders of alumina of different grain sizes are intimately mixed, whilst stirring for at least 24 hours. The alumina powder must not exceed 10% by weight of the mixture. A solvent is then added to the mixture so as to obtain a paste.

Figure 3B:
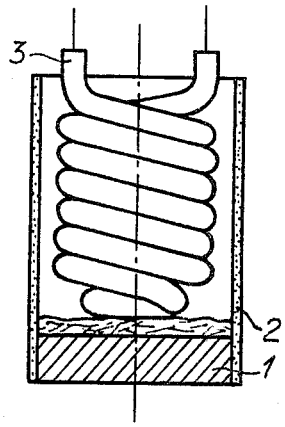
Figure 3C:
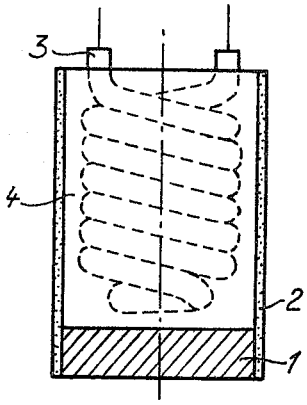

The surface of the emissive disk 1 directed towards the inside of cylinder 2 is then coated with this paste 5. This stage is shown in FIG. 3*a*. The solvent is then slowly evaporated by using an e.g. 100 W electric lamp or by allowing to dry naturally. Filament 3 is then introduced into cylinder 2, this stage being shown in FIG. 3*b*.

The cylinder is then filled a number of times with the paste, whose consistency can be modified by adding the solvent. On each occasion, when paste has been added to the cylinder, the solvent is evaporated by using the electric lamp. The solvent can be acetone.

Finally, fritting takes place under hydrogen, i.e., in a hydrogen atmosphere at e.g. atmospheric pressure at between 1700° and 1800° C. for approximately 30 minutes so as to obtain potting 4.

By slowly evaporating the solvent in proportion to the addition of the paste layer to the cylinder, the formation of bubbles due to a rapid evaporation of the solvent from all the paste filling the cylinder is avoided.

What is claimed is:

1. An electrical heating element for an indirectly heated cathode formed by a disk made from an emissive material occupying one of the ends of a cylinder made from a non-emissive material, the heating element being formed by a filament positioned within the cylinder and by a thermally conductive and electrically non-conductive fritted mixture of alumina and oxide filling the space left free by the filament within the cylinder, wherein the mixture is formed by alumina and at least 10% by weight of an oxide of one of the elements of column IIIB of the periodic table of elements, said mixture being fritted at between 1700° and 1800° C., said filament having electrical terminal connections extending outside of said mixture.

2. A heating element according to claim 1, wherein said mixture is formed by yttrium oxide and alumina of chemical composition $3Y_2O_3.5Al_2O_3$, plus α-phase alumina.

3. A heating element according to claim 1, wherein the mixture is formed from lanthanum oxide and alumina of chemical composition $La_2O_3.11Al_2O_3$, plus α-phase alumina.

4. A heating element according to claim 1, wherein the mixture is formed by scandium oxide and alumina of chemical composition $Sc_2O_3.Al_2O_3$, plus α-phase alumina.

5. A heating element according to claim 1, wherein the mixture incorporates a number of varieties of alumina of different grain sizes.

6. A heating element according to claim 5, wherein one of the varieties of alumina contains grains with a diameter of less than 10 μm, whilst the other variety contains grains with a diameter between 10 and 50 μm.

7. A heating element according to claim 1, wherein the filament is made from tungsten or rhenium tungsten covered by cataphoresis with an alumina insulating layer.

8. A method for the manufacture of a heating element wherein it comprises the following stages:

(a) the powder of an oxide of one of the elements of column IIIB of the periodic table of elements and one or more alumina powders of different grain size distributions are intimately mixed accompanied by stirring, the oxide powder not exceeding 10% by weight of the mixture, (b) a solvent is added to the mixture so as to obtain a paste, (c) the surface of the emissive disk facing the inside of the cylinder made from non-emissive material is coated with said paste and the solvent is then slowly evaporated, (d) the filament is introduced into the cylinder, (e) the cylinder is filled several times with the paste, whose consistency can be modified by adding the solvent, whilst evaporating the solvent on each occasion, (f) fritting takes place under hydrogen at between 1700° and 1800° C.

9. A heating element according to claim 7, wherein said alumina insulating layer is formed by the mixture of alumina and oxide constituting the remainder of the heating element.

10. An indirectly heated cathode comprising a cylinder of non-emissive material (2);

a disk of emissive material (1) positioned at one end of the cylinder;

an electrical heating filament (3) positioned within said cylinder and adapted to be connected to an electoral source for heating said filament;

a sintered mixture of alumina and oxide (4), formed by alumina and at least 10% by weight of an oxide of one of the elements of column IIIB of the periodic table of elements, occupying the space inside said cylinder and mechanically positioning said filament in place; said mixture being a good head conductor, and electrically insulating at the operating temperature of said cathode.

* * * * *